United States Patent [19]

Cook et al.

[11] Patent Number: 4,514,236

[45] Date of Patent: Apr. 30, 1985

[54] METHOD OF MANUFACTURING AN ARTICLE OF NON-MAGNETIC AUSTENITIC ALLOY STEEL FOR A DRILL COLLAR

[75] Inventors: William T. Cook, Sheffield; Michael Cristinacce, Rotherham; Rajendra K. Amin, Sheffield, all of England

[73] Assignee: British Steel Corporation, England

[21] Appl. No.: 470,975

[22] Filed: Mar. 1, 1983

[30] Foreign Application Priority Data

Mar. 2, 1982 [GB] United Kingdom ..... 8206104

[51] Int. Cl.[3] ..... C22C 38/40

[52] U.S. Cl. ..... 148/38; 148/137; 148/12 E; 148/12.4

[58] Field of Search ..... 75/123 N, 126 B, 128 A; 148/12 E, 37, 137, 38, 12.4

[56] References Cited

U.S. PATENT DOCUMENTS

| | | | |
|---|---|---|---|
| 2,789,048 | 4/1957 | DeLong | 75/126 B |
| 2,909,425 | 10/1959 | Hsiao et al. | 75/126 B |
| 3,112,195 | 11/1963 | Souresny | 75/128 A |
| 3,151,979 | 10/1964 | Carney et al. | 75/128 A |
| 3,698,889 | 10/1972 | Bungardt et al. | 75/123 N |
| 4,121,953 | 10/1978 | Hull | 75/126 B |
| 4,240,827 | 12/1980 | Aihara et al. | 75/126 B |
| 4,302,248 | 11/1981 | Kasamatsu et al. | 75/128 A |
| 4,373,951 | 2/1983 | Ouchi et al. | 75/126 B |
| 4,450,008 | 5/1984 | Andreini et al. | 148/38 |

FOREIGN PATENT DOCUMENTS

| | | | |
|---|---|---|---|
| 0154524 | 12/1980 | Japan | 148/137 |

*Primary Examiner*—L. Dewayne Rutledge
*Assistant Examiner*—Debbie Yee
*Attorney, Agent, or Firm*—Bacon & Thomas

[57] ABSTRACT

A non-magnetic austenitic alloy steel capable of producing the magnetic properties required in items such as Drill Collars in the as-rolled or as-rolled and direct quenched condition.

The steel composition includes by weight up to 0.5% carbon from 10 to 25% manganese, up to 20% chromium, not less than 0.2% nitrogen and from 0.2% nitrogen and from 0.2 to 2.0% vanadium.

8 Claims, No Drawings

METHOD OF MANUFACTURING AN ARTICLE OF NON-MAGNETIC AUSTENITIC ALLOY STEEL FOR A DRILL COLLAR

This invention relates to non-magnetic austenitic alloy steels and more especially, but not exclusively, to non-magnetic austenitic stainless steels suitable for the manufacture of such items as drill collars, and to methods of producing such steels.

Drill collars are used in deep hole drilling and are arranged between the drill tool and the adjacent drill pipe to provide the weight on the bit. To facilitate drill-hole surveying for directional drilling, a portion of these collars needs to be reliably non-magnetic and have a high strength comparable to that of conventional alloy steel drill collars. Hitherto non-magnetic steels for this use have either required forging with controlled finishing temperatures to produce the desired mechanical properties or have been manufactured from heat treated relatively expensive alloys e.g. those having high nickel and/or copper contents.

The present invention sets out in one aspect to provide a non-magnetic austenitic alloy steel capable of producing the mechanical properties required on items such as drill collars in the as-rolled or as-rolled and direct quenched condition. It is to be understood however that these steels can be produced by a number of routes which do not necessarily include a rolling stage.

According to the present invention in one aspect there is provided a non-magnetic austenitic alloy steel of composition which includes, by weight, up to 0.50% carbon, from 10 to 25% manganese, up to 20% chromium, not less than 0.20% nitrogen, and from 0.20 to 2.0% vanadium.

Preferably, the steel is of a composition which includes by weight, from 0.15 to 0.50% carbon, from 12 to 20% manganese, up to 18% chromium, not less than 0.20% nitrogen and from 0.20 to 1.0% vanadium. Further the steel is preferably an austenitic stainless steel including by weight from 0.2 to 0.4% carbon, from 12 to 20% manganese, from 10 to 16% chromium, from 0.2 to 0.6% Nitrogen, and from 0.2 to 1% vanadium.

One particular composition of a steel in accordance with the present invention is, by weight, as follows: from 0.20 to 0.40% carbon, up to 1.0% silicon, from 12.0 to 20% manganese, up to 0.10 phosphorous, up to 0.10 sulphur, from 10 to 16.0% chromium, up to 1.0 molybdenum, up to 1.0 nickel, from 0.20 to 0.60% nitrogen and from 0.20 to 1.0 vanadium.

A further steel in accordance with the present invention has the following composition by weight: from 0.30 to 0.35% carbon, from 0.40 to 0.60% silicon, from 17.5 to 19.0% manganese, up to 0.05% phosphorous, up to 0.05% sulphur, from 13.0 to 15.0% chromium, up to 1.0% molybdenum, up to 1.0% nickel, from 0.35 to 0.50% nitrogen and from 0.50 to 0.70% vanadium.

It is to be understood that various chemical elements may be added to the compositions referred to above to improve, enhance, or vary the properties of the compositions. Thus niobium up to 0.1% by weight may be added to produce additional strength increments.

The invention further provides a non-magnetic drill collar manufactured from a steel having a composition as set out in the preceding paragraphs.

According to the present invention in a still further aspect there is provided a method of manufacturing a non-magnetic austenitic steel having a composition in accordance with the present invention which comprises the steps of heating a steel bar bloom or ingot of the required composition to a temperature of the order of 1100° to 1250° C. and rolling such bloom or ingot to the required cross section and to a finish stock temperature below 1100° C.

The rolled product may subsequently be allowed to cool freely in air; alternatively, it may be quenched in oil or water.

The present invention further provides a high strength non-magnetic steel producing mechanical properties in excess of 700 N/mm$^2$ 0.2% proof stress in the as-rolled or as-rolled and quenched condition. Typically a magnetic permeability value ($\mu$) of 1.01 maximum is achieved.

The invention will now be described with reference to the following examples which are given by way of example only.

EXAMPLE 1

An ingot of the following composition by weight was produced:

0.30% carbon, 0.50 silicon, 18.0 manganese, 16.0 chromium, 0.46 nitrogen, and 0.79 vanadium. The ingot was forged to a 75 mm square billet. Billet samples were heated to 1180° and rolled to 30 mm×75 mm section, finishing below 1100° C. The resulting sections were cooled in air and the following properties achieved:

| 0.2% PS N/mm$^2$ | TS N/mm$^2$ | % El | R of A | Charpy 2 mm U-notch J. | Magnetic Permeability $\mu$ |
|---|---|---|---|---|---|
| 820 | 1110 | 33 | 51 | 64 | 1.002 |

EXAMPLE 2

An ingot of the composition set out below was produced and processed as described in Example 1 above, except that after rolling, it was both free air cooled and cooled in vermiculite. The cooling in vermiculite was carried out to simulate the air cooling of a 200 mm bar, whilst the air cooled section would simulate a quenched 200 mm bar.

Chemical composition by weight:

0.33% carbon, 0.53% silicon, 19.0% manganese, 12.0% chromium, 0.36 nitrogen, and 0.53 vanadium.

Properties:

| | 0.2% PS N/mm$^2$ | TS N/mm$^2$ | % El | R of A | Charpy 2 mm U-notch J. |
|---|---|---|---|---|---|
| Air cooled | 750 | 1030 | 38 | 52 | 120 |
| Vermiculite Cooled | 770 | 1055 | 23 | 45 | 70 |

EXAMPLE 3

Steel produced in an electric arc furnace was cast into 3 tonne ingots. Material was rolled to approximately 200 mm diameter. Material was both air cooled and quenched in water.

Composition by weight:

0.34% carbon, 0.53% silicon, 18.7% manganese, 14.0% chromium, 0.46% nitrogen and 0.59% vanadium.

Properties:

| | 0.2% PS N/mm² | 0.5% PS N/mm² | TS N/mm² | % El | R of A | Charpy 2 mm U-notch J. |
|---|---|---|---|---|---|---|
| Air cooled | 715 | 750 | 1020 | 33 | 36 | 30 |
| Water Quenched | 720 | 770 | 1040 | 35 | 42 | 60 |

Whilst the invention has been described with particular reference to steels suitable for the manufacture of drill collars, it is to be understood that steels in accordance with the invention have many other applications. Such applications include the manufacture of stabilisers for use in drilling oil wells, other non-magnetic down hole equipment, marine equipment, and non-magnetic generator end rings.

We claim:

1. A non-magnetic drill collar manufactured by a method comprising the steps of producing a feedstock having a composition consisting essentially of, by weight, up to 0.50% carbon, from 12 to 20% manganese, up to 1% silicon, up to 0.10% phosphorus, up to 0.10% sulphur, up to 20% chromium, up to 1% molybdenum, up to 1% nickel, from 0.20 to 0.60% nitrogen, from 0.20 to 1% vanadium, up to 0.1% niobium, balance iron apart from impurities and incidental ingredients, heating the feedstock to a temperature of between 1100° C. and 1250° C., rolling the heated feedstock to the cross-section required for the article in a controlled manner to achieve a finish temperature below 1100° C. and quenching the rolled feedstock, the article produced being characterized by a proof stress at 0.2% in excess of 700 N/mm² in the as-rolled condition.

2. A non-magnetic drill collar as claimed in claim 1 wherein the feedstock composition consists essentially of, by weight, from 0.15 to 0.40% carbon, from 17.5 to 19% managanese, from 0.40 to 0.60% silicon, up to 0.05% phosphorus, up to 0.05% sulphur, from 13 to 15% chromium, up to 1% molybdenum, up to 1% nickel, from 0.35 to 0.50% nitrogen, from 0.50 to 0.70% vanadium, up to 0.1% niobium, balance iron apart from impurities and incidental ingredients.

3. A non-magnetic drill collar manufactured by a method comprising the steps of producing a feedstock having a composition consisting essentially of, by weight, up to 0.50% carbon, from 12 to 20% manganese, up to 1% silicon, up to 0.10% phosphorus, up to 0.10% sulphur, up to 20% chromium, up to 1% molybdenum, up to 1% nickel, from 0.20 to 0.60% nitrogen, from 0.20 to 1% vanadium, up to 0.1% niobium, balance iron apart from impurities and incidental ingredients, heating the feedstock to a temperature of between 1100° C. and 1250° C., rolling the heated feedstock to the cross-section required for the article in a controlled manner to achieve a finish temperature below 1100° C. and cooling the rolled feedstock freely in air, the article produced being characterized by a proof stress at 0.2% in excess of 700 N/mm² in the as-rolled condition.

4. A non-magnetic drill collar as claimed in claim 3 wherein the feedstock composition consists essentially of, by weight, from 0.15 to 0.40% carbon, from 17.5 to 19% manganese, from 0.40 to 0.60% silicon, up to 0.05% phosphorus, up to 0.05% sulphur, from 13 to 15% chromium, up to 1% molybdenum, up to 1% nickel, from 0.35 to 0.50% nitrogen, from 0.50 to 0.70% vanadium, up to 0.1% niobium, balance iron apart from impurities and incidental ingredients.

5. A method of manufacturing an article of non-magnetic austenitic alloy steel, comprising the steps of producing a feedstock having a composition consisting essentially of, by weight, from up to 0.50% carbon, from 12 to 20% manganese, up to 1% silicon, up to 0.10% phosphorous, up to 0.10% sulphur, 10 to 16% chromium, up to 1% molybdenum, up to 1% nickel, from 0.20 to 0.60% nitrogen, from 0.20 to 1% vanadium, up to 0.1% niobium, balance iron apart from impurities and incidental ingredients, heating the feedstock to a temperature of between 1100° C. and 1250° C., rolling the heated feedstock to the cross-section required for the article in a controlled manner to achieve a finish temperature below 1100° C. and quenching the rolled feedstock, the article produced being characterised by a proof stress at 0.2% in excess of 700 N/mm² in the as-rolled condition.

6. A method as claimed in claim 5 wherein the feedstock composition consists essentially of, by weight, from 0.30 to 0.35% carbon, from 17.5 to 19% manganese, from 0.40 to 0.60% silicon, up to 0.05% phosphorous, up to 0.05% sulphur, from 13 to 15% chromium, up to 1% molybdenum, up to 1% nickel, from 0.35 to 0.50% nitrogen, from 0.50 to 0.70% vanadium, up to 0.1% niobium, balance iron apart from impurities and incidental ingredients.

7. A method of manufacturing an article of non-magnetic austenitic alloy steel, comprising the steps of producing a feedstock having a composition consisting essentially of, by weight, from up to 0.50% carbon, from 12 to 20% manganese, up to 1% silicon, up to 0.10% phosphorous, up to 0.10% sulphur, 10 to 16% chromium, up to 1% molybdenum, up to 1% nickel, from 0.20 to 0.60% nitrogen, from 0.20 to 1% vanadium, up to 0.1% niobium, balance iron apart from impurities and incidental ingredients, heating the feedstock to a temperature of between 1100° C. and 1250° C., rolling the heated feedstock to the cross-section required for the article in a controlled manner to achieve a finish temperature below 1100° and cooling the rolled feedstock freely in air, the article produced being characterised by a proof stress at 0.2% in excess of 700 N/mm² in the as-rolled condition.

8. A method as claimed in claim 7 wherein the feedstock composition consists essentially of, by weight, from 0.30 to 0.35% carbon, from 17.5 to 19% manganese, from 0.40 to 0.60% silicon, up to 0.05% phosphorous, up to 0.05% sulphur, from 13 to 15% chromium, up to 1% molybdenum, up to 1% nickel, for 0.35 to 0.50% nitrogen, from 0.50 to 0.70% vanadium, up to 0.1% niobium, balance iron apart from the impurities and identical ingredients.

* * * * *